US005488894A

United States Patent [19]

Schröder

[11] Patent Number: 5,488,894

[45] Date of Patent: Feb. 6, 1996

[54] HYDRAULIC AXIAL PISTON MOTOR

[75] Inventor: Klaus Schröder, Kirchdorf, Germany

[73] Assignee: Liebherr-Werk Bischofsbofen, Gesmbh, Bischofsbofen, Germany

[21] Appl. No.: 427,731

[22] Filed: Apr. 24, 1995

Related U.S. Application Data

[63] Continuation of Ser. No. 117,235, Sep. 7, 1993.

[30] Foreign Application Priority Data

Sep. 16, 1992 [DE] Germany ..... 9212469 U

[51] Int. Cl.[6] ..... F03C 1/40

[52] U.S. Cl. ..... 91/505

[58] Field of Search ..... 91/505, 485

[56] References Cited

U.S. PATENT DOCUMENTS

| | | | |
|---|---|---|---|
| 4,033,238 | 7/1977 | Wagenseil | 91/505 |
| 5,182,978 | 2/1993 | Akasaka et al. | 91/505 X |

FOREIGN PATENT DOCUMENTS

| | | | |
|---|---|---|---|
| 2512068 | 9/1976 | Germany | 91/505 |
| 3119994 | 3/1982 | Germany | 91/505 |

*Primary Examiner*—Richard E. Gluck
*Attorney, Agent, or Firm*—Morgan & Finnegan

[57] ABSTRACT

A hydraulic axial piston motor (1) of the bent axis type comprises a drive shaft (3) fixedly connected with a drive disk (4), a cylinder block (10) which is provided with mutually parallel cylinder bores (9) on a circular line in which pistons (8) are arranged to run, and the pistons being connected in an articulating manner with the drive disk (4), which is pivotally bearinged about a transverse axis (37) and arranged adjacent to the drive disk (4). A flow control disk (16), which on its side facing the cylinder block (10) is provided with two arcuate flow control slots (24 and 25) and is also provided with a cylindrical outer side (23), whose central axis of curvature coincides with the pivot axis (37) of the cylinder block (10) and is bearinged in a terminal plate (15) secured to the housing and which is provided with supply and drain ports (21 and 40), and which disk is provided with recesses which are at least partly in alignment with the supply and drain ports and are connected with a flow control slot. In order to ensure that the motor does not run away on pivoting out of the stall range towards a range with larger pivot angles, on its cylindrically curved side (23) the flow control disk (16) is provided with a flow control edge (20) delimiting an aperture (29) and which on pivoting the cylinder block (10) towards 0° increasingly closes the supply port (21).

1 Claim, 6 Drawing Sheets

MULTI-MOTOR DRIVE

HYDRAULIC AXIAL PISTON MOTOR

This is a continuation of application Ser. No. 08/117,235, filed on Sep. 7, 1993.

FIELD OF THE INVENTION

The invention relates to a hydraulic axial piston motor of the bent axis type comprising a drive shaft fixedly connected with a drive disk, a cylinder block, which is provided with mutually parallel cylinder bores on a circular line in which pistons are arranged to run, the pistons or piston rods thereof being connected in an articulating manner with the drive disk, and which block is pivotally bearinged about a transverse axis arranged adjacent to the drive disk, and furthermore a flow control disk, which on its side facing the cylinder block is provided with two heart-shaped flow control slots and is provided with a cylindrical outer side, whose axis of curvature coincides with the pivot axis of the cylinder block, which flow control disk is bearinged in a terminal plate secured to the housing and has supply and drain slots, and which is provided with apertures which are at least partly in alignment with the supply and drain slots and are connected to the flow control slots.

BACKGROUND

Such a hydraulic axial piston motor with an adjustable speed of rotation is, for example, the variable displacement motor A6VM manufactured by Mannesmann Rexroth Company. In the case of such motors owing to the provision of a hydraulic setting device arranged in the terminal plate and having a pin running in a hole in the flow control disk it is possible for the cylinder block, which is supported in a freely rotatable manner in the recess having the form of a spherical segment of the correspondingly complementary spherical segment-like inner side of the flow control disk, to be moved between its maximum pivot angle at 26.5° at which the motor produces maximum torque at the minimum speed of rotation, and a pivot angle approximately equal to 0°. Because on approaching a pivot angle of 0° there is a reduction in torque, at a pivot angle range of generally 2° to 3° the motor will enter the stall range. If, however, the motor is pivoted out of the 0° pivot angle range or, respectively, out of the stall range towards a larger pivot angle, it will, in the absence of any external load, quickly run up to speeds of rotation in excess of the permissible speeds after leaving the stall range. This is because at small pivot angles, the intake volume which is necessary for achieving high and impermissible speeds of rotation is relatively small.

Hydraulic variable displacement motors of the type initially mentioned are more especially utilized for multi-motor drives. Such a motor is illustrated diagrammatically in FIG. 13 of the drawings herein. In the case of this multi-motor drive, a variable displacement motor is constantly coupled via a common output shaft, whereas further variable displacement motors may be connected via couplings and suitable gearing stages, which may be even able to be connected and disconnected, in order to run through the speed of rotation-torque ranges which are optimum for given purposes of application. In the case of such drives there is the particular problem of "jerks" occurring while connecting variable displacement motors which have been uncoupled. Such jerks occur because the motor is still in its stall range, or because when the motor is supplied with hydraulic oil and is not under load, it immediately runs up to its maximum speed.

OBJECTS OF THE INVENTION

One object of the invention is to provide a variable displacement axial piston motor of the type initially mentioned, in the case of which on pivoting out of the stall range towards a larger pivot angle, the motor is not run up to an impermissible high speed.

SUMMARY OF THE INVENTION

In accordance with the invention, this object is to be achieved in the case of a motor of the type initially mentioned because on its cylindrically curved side, the flow control disk is provided with a flow control edge delimiting an aperture and which on pivoting the cylinder block towards 0° increasingly closes the supply port. Therefore, in the motor in accordance with the invention, the supply port constituting the high pressure side is increasingly shut off on pivoting of the cylinder block towards the 0° pivot angle setting, so that the hydraulic liquid under high pressure is increasingly choked, the supply port being able to be completely shut off in the stall range. If then the motor is started again by pivoting of the cylinder block to increase the pivot angle, then by a suitable arrangement of the flow control edge it is possible for the designer to provide for a controlled supply of hydraulic oil under pressure to the pressure side of the cylinder block in such a manner that the motor will assume a certain speed of rotation.

If, for example, the variable displacement motor in accordance with the invention is employed for multi-motor drives, then by pivoting the cylinder block out of the stall range towards a larger pivot angle it is possible to open up the port supplying the hydraulic oil under pressure in such a manner that the motor will run at predetermined speeds of rotation and more particularly will run at speeds in the synchronous range so that the connection of the one or other variable displacement motor may be performed without any jerk.

BRIEF DESCRIPTION OF THE DRAWINGS

One embodiment of the invention will now be described in more detail with reference to the drawings in which.

DETAILED DESCRIPTION OF THE DRAWINGS

Figure 1:
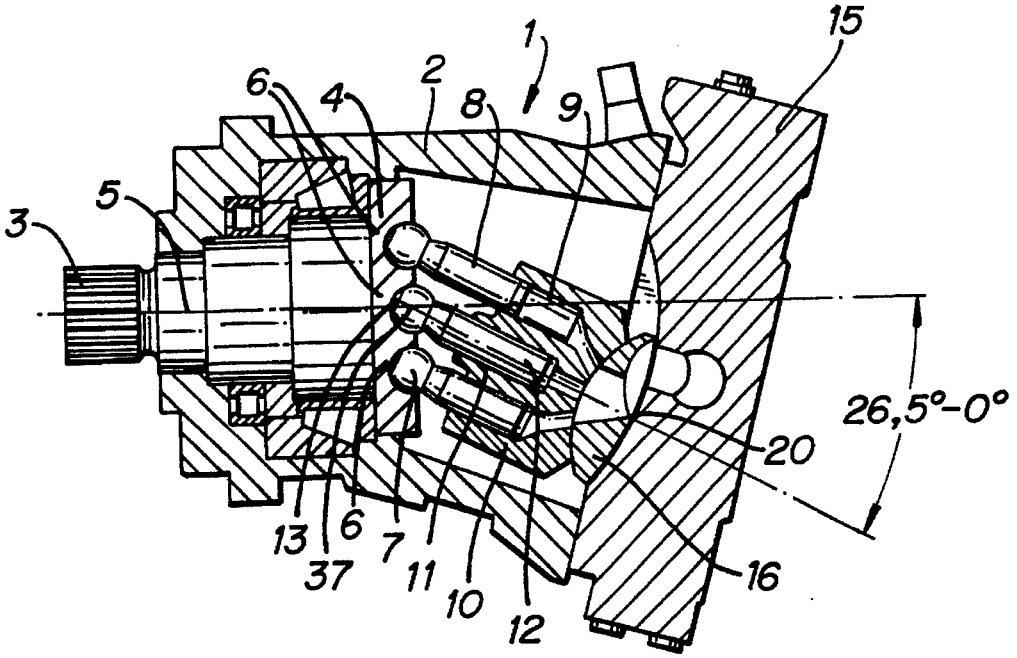
FIG. 1 is a diagrammatic cross section taken through a variable displacement hydraulic axial piston motor with a bent 6 axis, the motor being illustrated at the maximum pivot angle of its cylindrical block.
Figure 2:
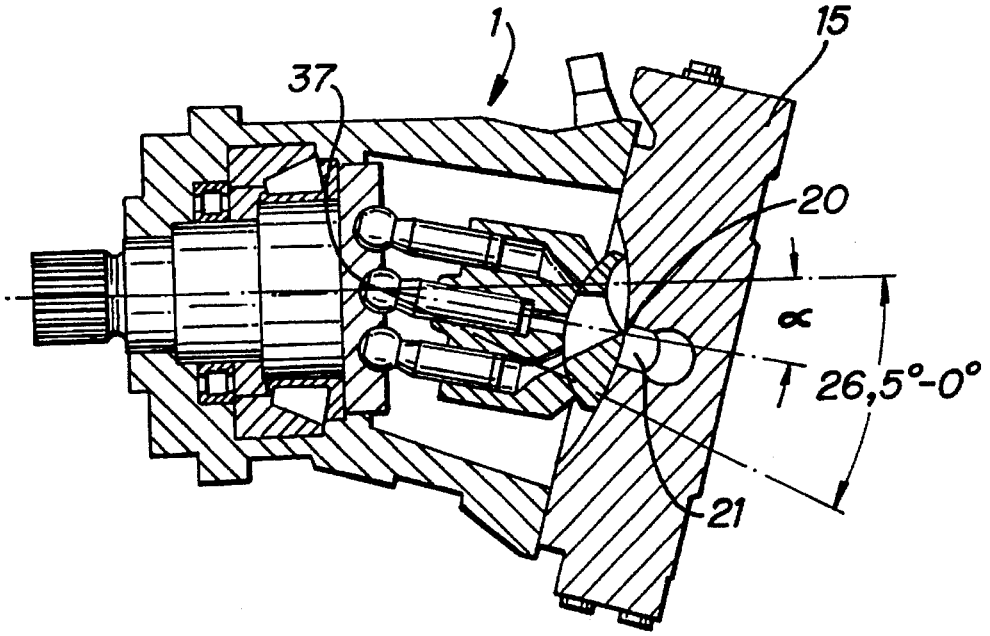
FIG. 2 is a cross section similar to that of FIG. 1 with the pivot angle approaching the stall range.
Figure 3:
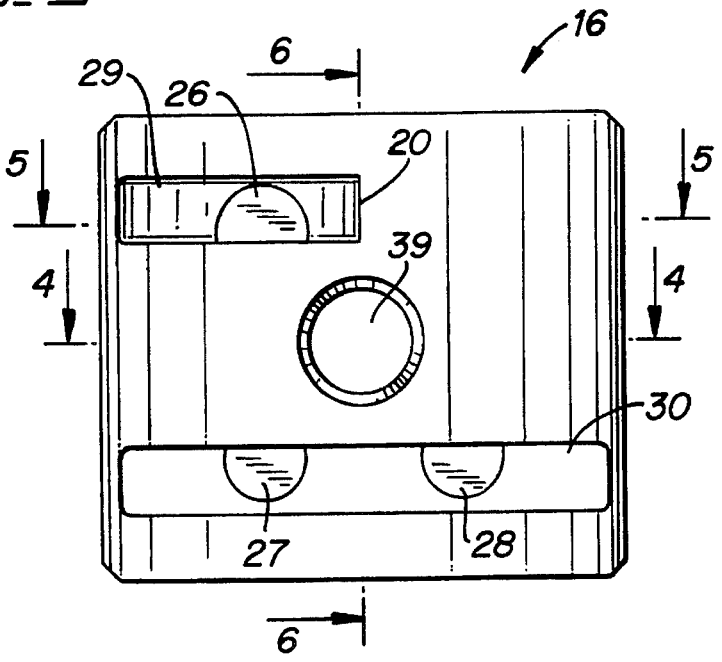
FIG. 3 is a plan view of the outer cylindrically curved side of the flow control disk.
Figure 4:
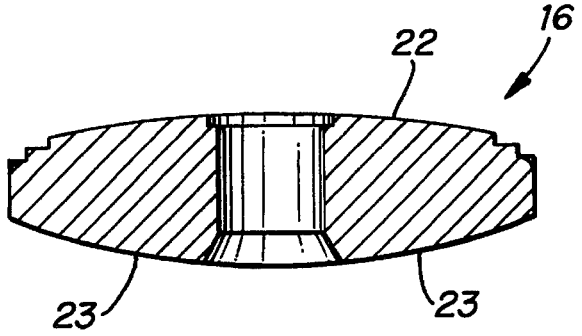
FIG. 4 is a section taken through the flow control disk as depicted in FIG. 3 along the line 4—4 of FIG. 3.
Figure 5:
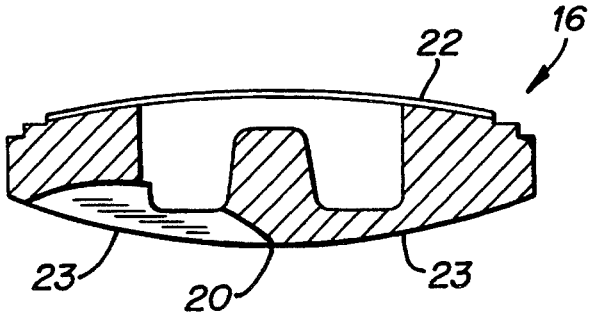
FIG. 5 is a section taken through the flow control disk of FIG. 3 on the line 5—5 of FIG. 3.
Figure 6:
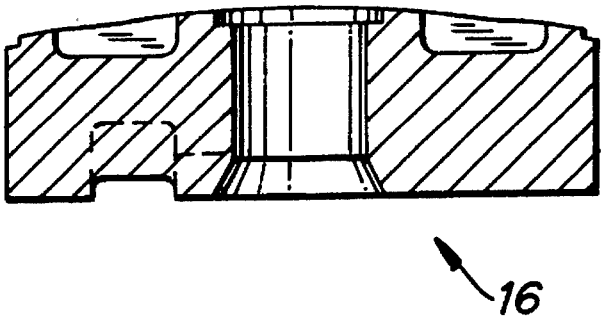
FIG. 6 is a section taken through the flow control disk of FIG. 3 on the line 6—6 of FIG. 3.

FIGS. 1 and 2 show a variable displacement hydraulic axial piston motor of the bent axis type, which in its basic design is generally similar to the variable displacement motor type A6VM of the Mannesmann Rexroth Company, so that a more detailed description thereof is not required and reference may be had to publications of the said Company.

Such a known variable displacement motor comprises a drive shaft 3 bearinged in a housing 2 forming a well, W, as shown in the type A6VM motor mentioned above; and which is integrally jointed with a drive disk 4. The drive disk 4 is provided with recesses 6 having the form of spherical segments arranged on a circular line concentric about the axis 5 of the shaft so that the spherical heads 7 of pistons 8 fit into such recesses, such pistons running in bores 9 of the cylinder block 10. The cylinder block 10 is provided with a central hole 11, in which a piston 12 serving for centering is arranged, whose spherical head 13 fits into a corresponding recess, shaped like a cylindrical segment, in the middle of the drive disk 4. The piston 12 virtually defines the axis of rotation of the cylinder block 10.

On its side facing the terminal plate 15, the cylinder block 10 is provided with a recess having the form of a spherical segment, into which fits the inner, complementary part-spherical inner side of the flow control disk 16. The flow control disk 16 has a cylindrically curved outer side, which fits into a complementary recess having the form of a complementary spherical segment, in the terminal plate 15. The terminal plate 15 is provided with two parallel slot-like inlet and outlet ports for the hydraulic oil under high and low pressure. The generally discus-like flow control disk has apertures, of which the aperture for the supply port is provided with a flow control edge 20, which on pivoting of the cylinder block 10 towards the 0° pivot angle position incremental shuts off the supply port 21 in the manner indicated in FIG. 2.

The design of the flow control disk in accordance with the invention will now be explained with reference to FIGS. 3 through 7 in more detail. The flow control disk 16 has, as seen in plan, a generally rectangular configuration. On the side thereof facing the cylinder block 10 it is provided with a bulge 22 having the form of a spherical segment, the bulge functioning as a support surface for the part-spherical outer side of the cylinder block 10. On the opposite side 23 thereof the flow control disk 16 is curved in the form of a cylindrical segment.

Figure 7:
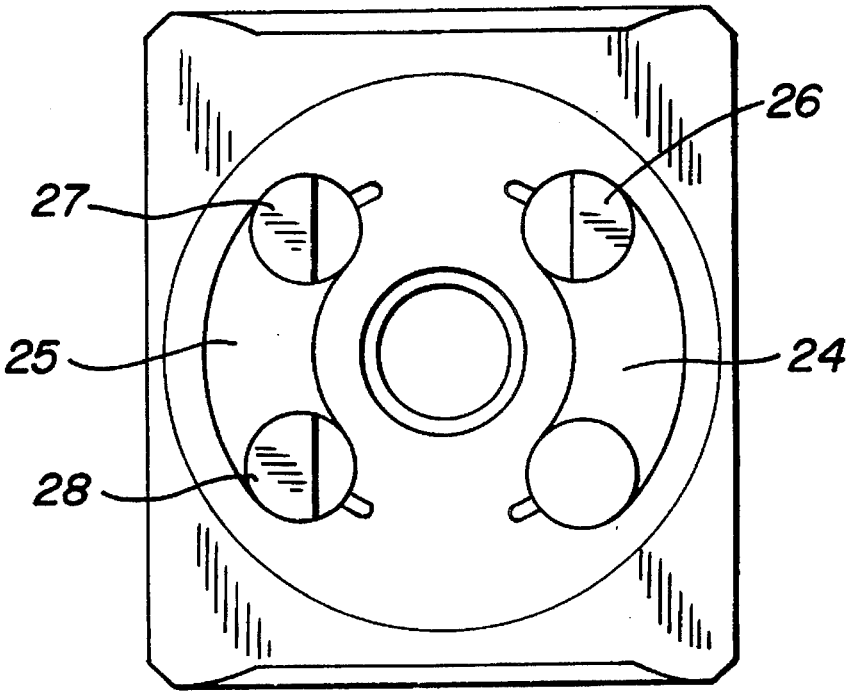
FIG. 7 is a view of the flow control disk as seen from the cylinder block side thereof.
Figure 8:
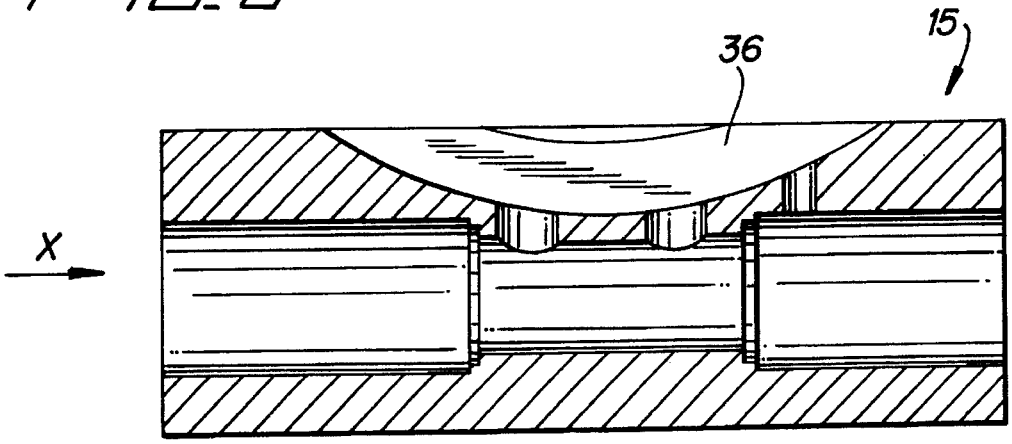
FIG. 8 is a section in elevation taken through the terminal plate on the line 7—7 of FIG. 9.
Figure 9:
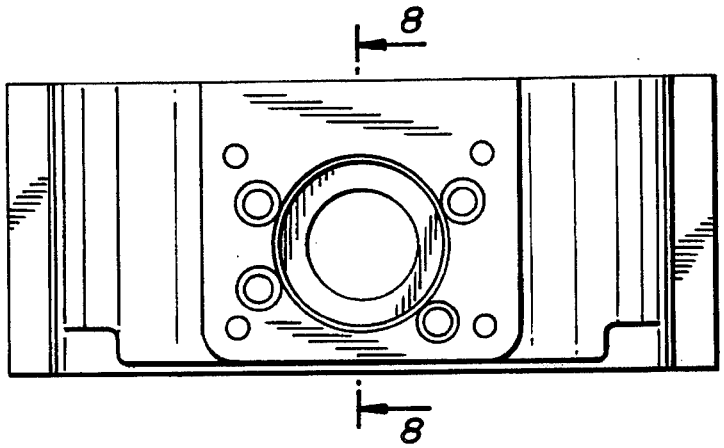
FIG. 9 is an elevation of the terminal plate looking in the direction of the arrow "X" in FIG. 8.

On its side with the form of a spherical segment the flow control disk 16 is provided, in the manner to be seen in FIG. 7, with heart like alots 24 and 25, of which the slot 24 is on the high pressure side and the slot 25 on the low pressure side.

The slots are connected via ports 26, 27 and 28 with recesses 29 and 30, which are machined in the cylindrically curved side 23 of the flow control disk 16. The recess 30 for the low pressure side extends over generally the full length of the cylindrically curved outer surface of the flow control disk 16, whereas the recess 29 is closed off generally adjacent to the central transverse axis 6—6 of the flow control disk by the flow control edge 20.

On the basis of FIGS. 8 through 12 the terminal or end plate will now be described, in which the flow control disk is pivotally bearinged by making contact at its cylindrical outer surface. The terminal or end plate 15 is provided with a recess 36 having the form of a cylindrical segment, whose width is the same as the width of the flow control disk 16. The recess 36 with the form of a cylindrical segment is provided in its central part with a cylindrically curved groove 37, in which a slot 38 is centrally arranged, in which in turn a hydraulically driven pin runs, which fits into the central hole 39 in the flow control disk 16 and which by means of the flow control disk 16 pivots the cylinder block about the pivot axis 37.

Figure 10:
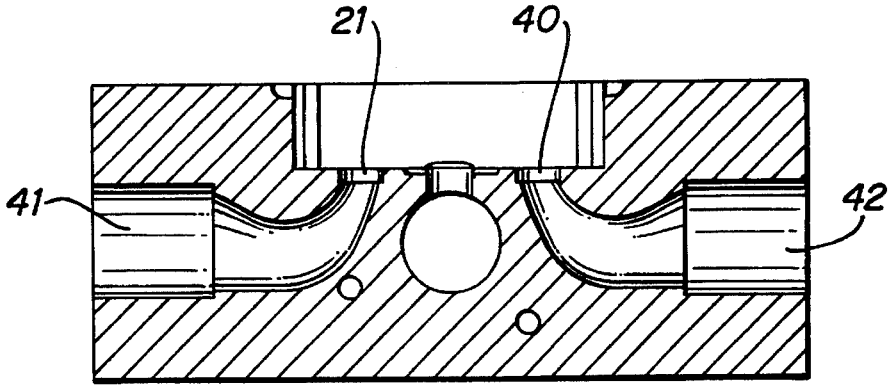
FIG. 10 is section in elevation taken through the terminal plate on the line 9—9 of FIG. 12.
Figure 11:
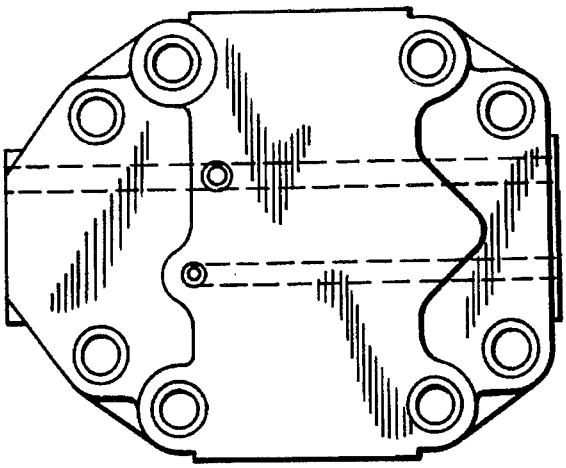
FIG. 11 is a view of the terminal plate.
Figure 11A:
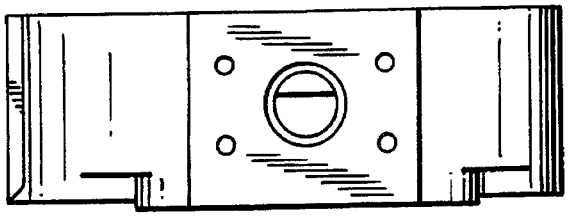
FIG. 11a is a view in elevation of the terminal plate shown in FIG. 11.
Figure 12:
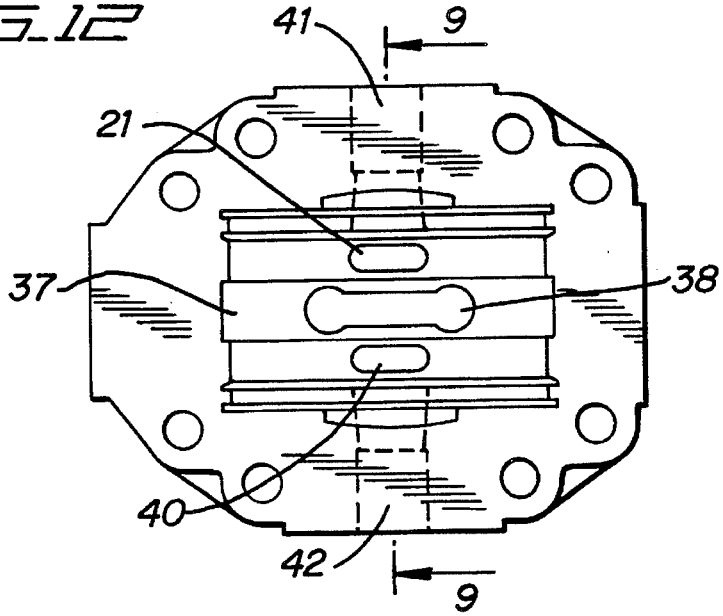
FIG. 12 is an elevation of the terminal plate as seen from the flow control disk side thereof.

In the lateral portions of the recess 36 with the form of a cylindrical segment slots 21 and 40 are machined, of which, in the manner indicated in FIGS. 10 and 12, the slot 21 is connected with the a supply port 41 on the high pressure side and the slot 40 is connected with a port 42 on the low pressure side.

If the motor is set with a major degree of pivot as shown in FIG. 1, the recess 29 will be fully in alignment with the slot 21 on the high pressure side. If, however, the motor is reset to reduce the angle of pivot, the flow control edge will move over the slot 21 to an ever greater extent and will shut it more and more until the slot 21 is completely shut off in the stall range as indicated in FIG. 2.

Figure 13:
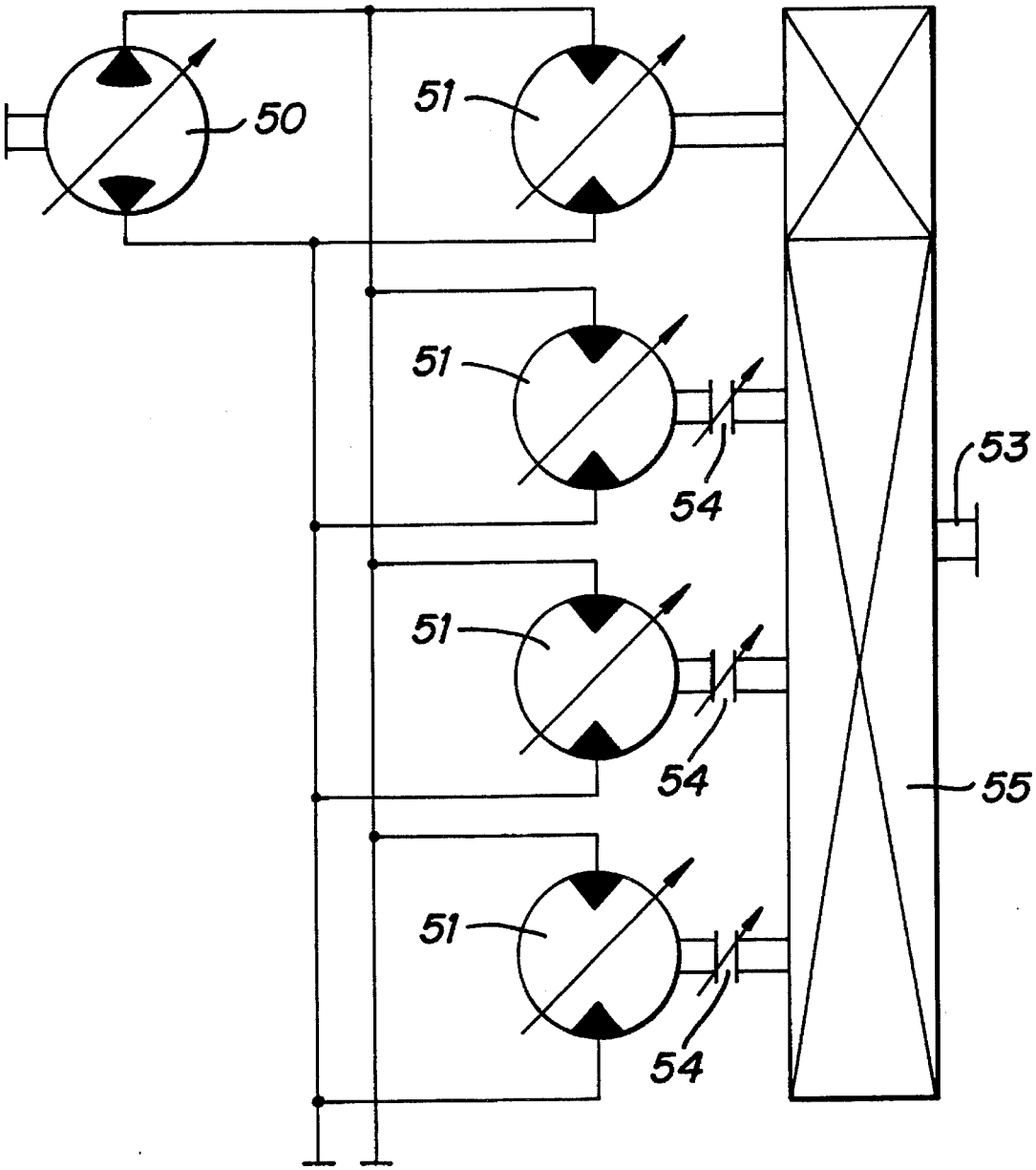
FIG. 13 is a diagrammatic representation of a multi-motor drive utilizing motors connected in parallel.

FIG. 13 shows a multi-motor drive, in the case of a hydraulic variable displacement pump 50 is connected in any hydraulic parallel circuit for supplying a plurality of hydraulic axial piston motors 51 of the type described with the hydraulic oil under high pressure. The uppermost variable displacement motor 51 is constantly drivingly connected with the common drive shaft 53, whereas the lowermost three variable displacement motors 51 are able to be connected via couplings 54 and gearing means (not illustrated) of the transmission 55 with the drive shaft 53.

The illustrated multi-motor drive renders possible a large range of adjustment, it being necessary to be able to connect and disconnect individual variable displacement motors 51. A complete disconnection of motors pivoted to the 0° setting is performed by the couplings 54 so that it is unnecessary for motors to be entrained which are not actually driving. In order to be able to engage the couplings 54 without jerks, the variable displacement motors is accordance with the invention may be run at approximately the synchronous speed of rotation by suitable control adjustment of the supply cross sections on the high pressure side.

I claim:

1. A hydraulic axial piston motor (1) of the bent axis type comprising: a housing forming a well, W, a drive shaft (3) fixedly connected with a drive disk (4) located in said housing;

a cylinder block (10) pivotally movable in said well, W, and which is provided with mutually parallel cylinder bores (9) on a circular line in which pistons (8) are arranged to run, wherein the pistons are connected in an articulating manner with said drive disk (4), said cylinder block pivotally bearinged about a transverse axis (37) arranged adjacent to said drive disk (4);

a flow control disk (16), having a side facing said cylinder block (10) and a cylindrical outer side (23) provided with two arcuate flow control slots (24 and 25) whose central axis of curvature coincides with the pivot axis (37) of the cylinder block (10), said flow control disk bearinged in a terminal plate (15) secured to said housing, said terminal plate having supply and drain ports (21 and 40), said control disk provided with recesses (29 and 30) which are at least partly in alignment with said supply and drain ports and are connected with the flow control slots, characterized in that on its cylindrical outer side (23) said flow control disk (16) is provided with a flow control edge (20) delimiting the recess (29) and which on pivoting the cylinder block (10) in said well, W, towards 0° increasingly closes the supply port (21).

* * * * *